US012674394B2

(12) United States Patent
Russell

(10) Patent No.: US 12,674,394 B2
(45) Date of Patent: Jul. 7, 2026

(54) PROPELLER

(71) Applicant: Conic Propulsion, LLC, Newport Beach, CA (US)

(72) Inventor: Thomas A. Russell, Newport Beach, CA (US)

(73) Assignee: Conic Propulsion, LLC, Newport Beach, CA (US)

( * ) Notice: Subject to any disclaimer, the term of this patent is extended or adjusted under 35 U.S.C. 154(b) by 0 days.

(21) Appl. No.: 19/387,237

(22) Filed: Nov. 12, 2025

(65) Prior Publication Data

US 2026/0071546 A1 Mar. 12, 2026

Related U.S. Application Data

(63) Continuation-in-part of application No. 19/226,509, filed on Jun. 3, 2025, now Pat. No. 12,497,892, which is a continuation of application No. 18/070,295, filed on Nov. 28, 2022, now Pat. No. 12,326,097, which is a continuation of application No. 17/676,507, filed on Feb. 21, 2022, now Pat. No. 11,512,593, which is a continuation-in-part of application No. 17/198,232, filed on Mar. 10, 2021, now Pat. No. 11,254,404, which is a continuation-in-part of application No. PCT/US2020/049752, filed on Sep. 8, 2020, and a continuation-in-part of application No. 16/561,597, filed on Sep. 5, 2019, now abandoned.

(51) Int. Cl.
*F01D 5/02* (2006.01)
*B63H 1/20* (2006.01)

(52) U.S. Cl.
CPC ..... *F01D 5/021* (2013.01); *B63H 1/20* (2013.01)

(58) Field of Classification Search
CPC .... B63H 1/14; B63H 1/20; B63H 1/26; B63C 11/16; B64C 27/46; B64C 27/467; F03D 1/0633; F03B 3/121; F04D 29/384; F04D 29/386; F01D 5/14; F01D 5/141; F01D 5/021
USPC ..... 416/243, 223 R
See application file for complete search history.

(56) References Cited

U.S. PATENT DOCUMENTS 1,733,671 A * 10/1929 Moody ..... F03B 3/121 29/889.7
2,460,902 A * 2/1949 Odor ..... F04D 29/325 416/243
2,667,936 A * 2/1954 Clark ..... B63H 1/18 416/223 R
4,135,858 A * 1/1979 Entat ..... F04D 29/384 416/223 R
11,512,593 B2 * 11/2022 Russell ..... B63H 1/26

* cited by examiner

*Primary Examiner* — Nathaniel E Wiehe
*Assistant Examiner* — Justin A Pruitt
(74) *Attorney, Agent, or Firm* — Crockett & Crockett, PC; K. David Crockett, Esq.

(57) ABSTRACT

A propeller. The blade thrust surfaces of the propeller correspond to the surface of a cone, and the hub axis is set at an angle relative to a first generator line of the cone which passes through the hub axis and a second generator line of the cone which passes through the blade thrust surface to achieve desired gamma angles over the blade thrust surface. A propeller whose blade center axis does not conform to a generator line of a cone also is disclosed.

7 Claims, 14 Drawing Sheets symbol for forward view of hub

Side view

Aft view

Cross-section

Top view

PROPELLER

This application is a continuation-in-part of U.S. application Ser. No. 19/226,509, filed Jun. 3, 2025, pending, which is a continuation of U.S. application Ser. No. 18/070,295, filed Nov. 28, 2022, which is a continuation of U.S. application Ser. No. 17/676,507, filed Feb. 21, 2022, now U.S. Pat. No. 11,512,593, which is a continuation-in-part of U.S. application Ser. No. 17/198,232, filed Mar. 10, 2021, now U.S. Pat. No. 11,254,404, which is a continuation-in-part of U.S. application Ser. No. 16/561,597, filed Sep. 5, 2019, abandoned, and a continuation-in-part of PCT Application PCT/US2020/049752, filed Sep. 8, 2020.

FIELD OF THE INVENTIONS

The inventions described below relate to the field of nautical and aeronautical propellers.

BACKGROUND OF THE INVENTIONS

Most propellers use blades which conform to the shape of a screw. These are referred to as helicoidal propellers. Helicoidal propellers create a large amount of turbulence compared to the thrust they generate, and various modifications are employed to decrease turbulence and increase thrust. Other forms of propellers have been proposed, but not widely adopted.

Conical propellers described in the prior art include Entat, Method of Producing Propeller Blades and Improved Propeller Blades Obtained by Means of this Method, U.S. Pat. No. 4,135,858 (Jan. 23, 1979). Entat's propeller blades conform to the surface of a reference cone, and the axis of rotation of his propeller is coincident with a vertex of the reference cone. The blades of Entat span a large circumference of the reference cone (about 135° at the root). Moreover, the faces of Entat's propeller blades are angled toward the axis of rotation. This results in large inefficiencies as much of the fluid flow caused by rotation of the propeller blades is directed radially inward, rather than axially away from the thrust surface.

SUMMARY

The propellers described below provide for increased thrust and decreased turbulence with blades shaped to conform to the surface of a cone. Each blade is characterized by a blade center axis which corresponds to a generator line of a cone to which the blade, or blade thrust surface, conforms. The propeller hub is fixed to each blade at the root, in line with the blade center axis, such that the hub axis and blade center axis lie in the same plane, and the leading edge of the blade is positioned forward (referring to the upstream direction of movement caused by the propeller) of the trailing edge of the blade.

The conical propeller may be modified such that each blade subtends 90° or less of the reference cone circumference, and more preferably 45° or less of the reference cone circumference. The conical propeller may also be modified such that the blade's axis of rotation intersects a generator line at a distance of at least half the length of the distance from the blade root to tip as measured along the generator line that passes through the axis of rotation, and up to approximately the length of the blade's radial axis away from the cone's vertex.

DETAILED DESCRIPTION OF THE INVENTIONS

Figure 1:
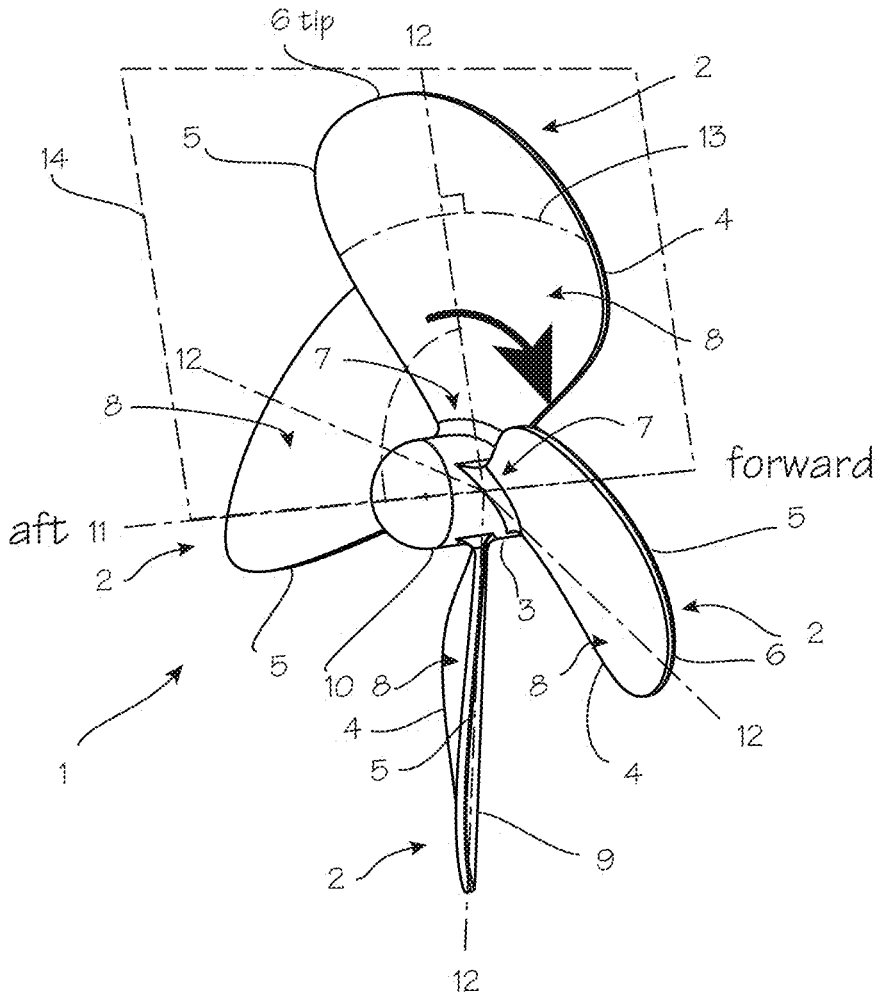
FIG. 1 is an aft perspective view of a marine propeller.
Figure 2:
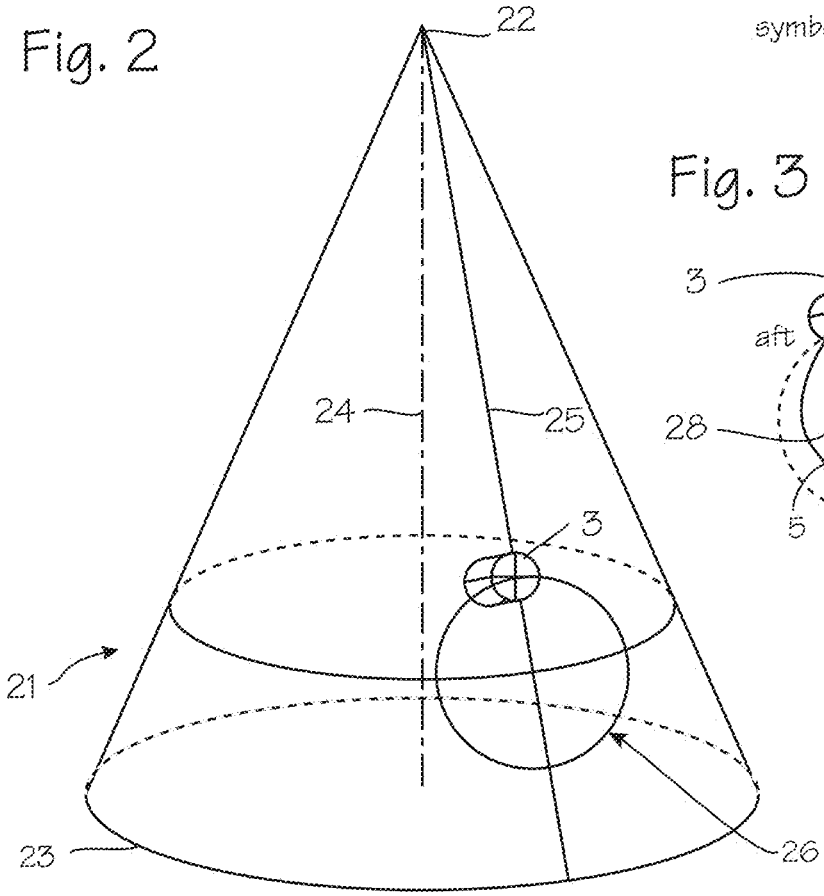
FIG. 2 illustrates the form of the propeller blades in relation to a hypothetical cone used to define features of the blades, from a forward perspective.
Figure 2:
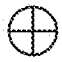
Figure 6:
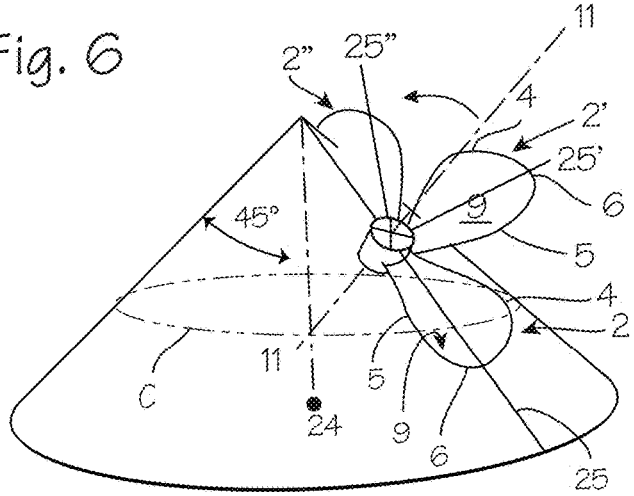
FIG. 6 provides an additional illustration of the form of the propeller blades in relation to a hypothetical cone used to define features of the blades, from a forward perspective.
Figure 7:
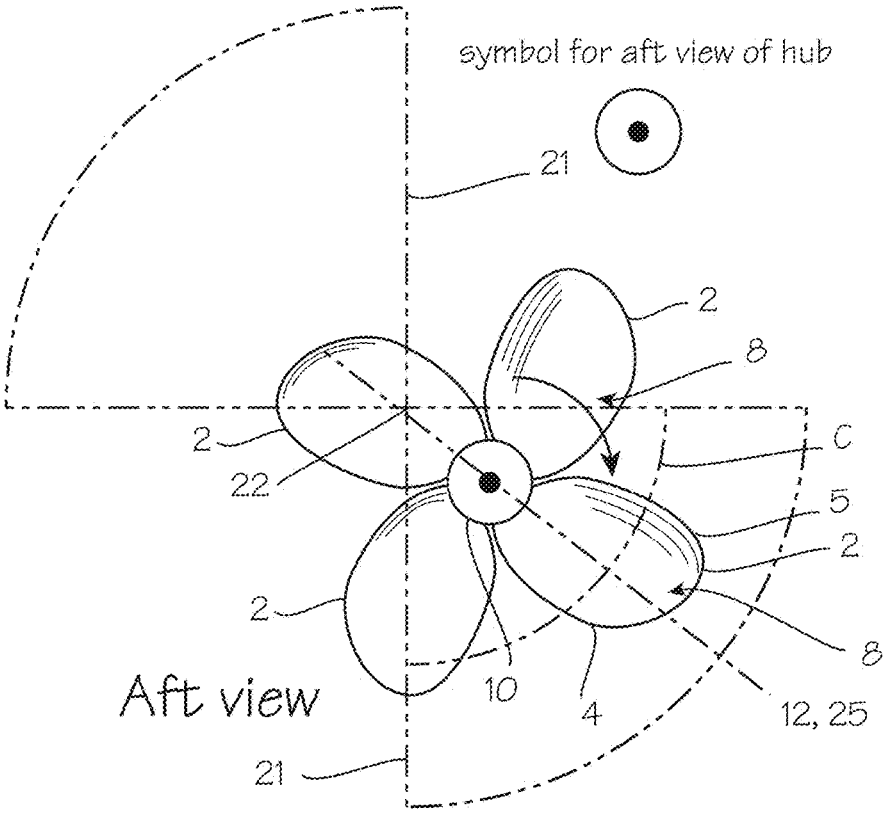
FIG. 7 illustrates the form of the propeller blades in relation to a hypothetical cone used to define features of the blades, in an aft view of the propeller.

FIG. 1 is an aft perspective view of a marine propeller with blades having surfaces conforming to the surface of a cone. The propeller 1 includes blades 2 disposed about and mounted on a hub or boss 3. Each blade is characterized by a leading edge 4, a trailing edge 5, a tip 6, a root 7, a thrust surface 8 (also referred to as the blade face, the pressure surface or the aft surface), and a blade back (the forward surface or suction surface) 9. The hub is typically terminated in a cap 10, and is characterized by a hub axis 11. The hub axis is the axis of rotation of the propeller. As shown in the illustration, the leading edge of each blade is forward of the trailing edge. Each blade is characterized by a blade center axis 12 (also referred to as the radial axis), which may or may not be perpendicular to the hub axis 11 (the blade center axis may or may not be located in the geometric center of the blade). The blade center axis, or radial axis, lies on the generator line that goes through the axis of rotation of the propeller. (The radial axis in this illustration corresponds to the generator line of a cone used as a reference to define aspects of the blade, as shown in FIGS. 2, 6 and 7). A leading-to-trailing line 13, perpendicular to the radial axis 12, is referred to herein as a pitch line. The hub axis 11 and the blade center axis 12 of blade lie in plane 14.

FIG. 2 illustrates the form of the propeller blades in relation to a reference cone used to define features of the blades, from a forward perspective. The reference cone 21 is characterized by a vertex (apex) 22, a round (preferably circular) base 23, a vertical axis 24 and any number of generator lines exemplified by generator line 25. The cone may be a right cone (the vertical axis 24 passes through the center of the circular base at a right angle), or an oblique cone with a circular or elliptical base, though a right circular cone is preferred because it can provide parabolic curvature on the blade surfaces. In reference to the reference cone, the thrust surface of the blade conforms to a section of the reference cone, such as section 26, centered on the generator line 25, which establishes the radial axis 12 of the blade shown in FIG. 1. The hub 3 is shown in relation to the reference cone, intersecting the surface of the cone and centered on the same generator line as the section of the reference cone. The hub and hub axis are preferably displaced from the vertex of the reference cone, toward the section 26, but may be coincident with the vertex. The hub axis 11 may be oriented perpendicular to the surface of the reference cone so that it intersects the generator line at a right angle and also intersects the vertical axis (at an angle dependent on the vertex angle) or angled relative to the surface of the cone (left or right about the generator line) while intersecting the generator line at a right angle (this provides the twist necessary for a symmetric blade), and may also be angled relative to the radial axis/generator line while also intersecting the vertical axis 24 (this provides rake) and may also be angled relative to the radial axis/generator line while also not intersecting the vertical axis 24 (this provides twist and rake). Thus, the hub axis 11 may intersect the generator line at a right angle, or at an acute or obtuse angle relative to the thrust surface of the blade or corresponding section of the reference cone. (Correspondingly, the resulting blade may be raked forward or aft on the hub.) Also, the hub axis may intersect the vertical axis 26 (lie in the same plane) or depart from the vertical axis. (Correspondingly, the resulting blade will be twisted or rotated about the blade center axis relative to the hub axis, to set the leading edge forward of the trailing edge). Each blade may be rotated about its generator line, or trimmed asymmetrically about its blade center axis, such that its average pitch angle relative to the hub is different from that which it would have had without such rotation or trimming.

Figure 3:
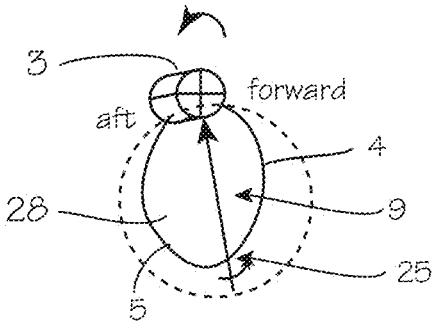
FIGS. 3, 4 and 5 illustrate variations in blade outlines.
Figure 4:
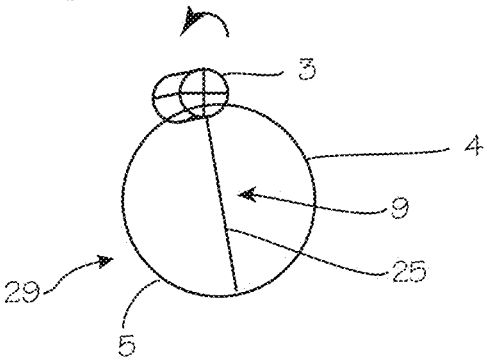
Figure 5:
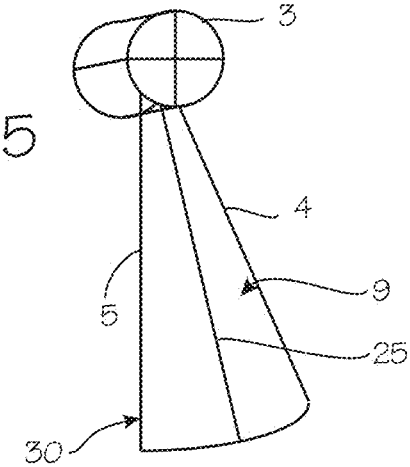

FIGS. 3, 4 and 5 illustrate possible blade outer contours. The blade outline may be elliptical (28) as shown in FIG. 3, circular (29) as shown in FIG. 4, or wedge shaped (30), as a wedge bounded by two generator lines spaced from the generator line 25 with the straight-cut tip as shown, in FIG. 5. The blade outline may be slightly or highly skewed, arc-tipped, scimitar-shaped, or any other shape that provides thrust.

FIG. 6 provides an additional illustration of the form of the propeller blades in relation to a hypothetical cone used to define features of the blades, from a forward perspective, showing how one blade would appear on the reference cone when the propeller is assembled. In this view, several of the blades 2, 2' and 2" are shown, with one blade 2 superimposed on the surface of the reference cone 21, which in this illustration is a 90° right cone, with a 45° angle between the vertical axis 24 and the generator line 25. This Figure shows the hub axis 11 which is perpendicular to the generator line 25, but does not intersect the vertical axis 24. This makes clear that, for blades conforming to the surface of a right cone, planes parallel to the hub axis 11 will intersect the thrust surfaces along parabolic curves. The blades 2' and 2" are shown projecting out of the surface of the reference cone, along with corresponding generator lines 25' and 25".

FIG. 7 illustrates the form of the propeller blades in relation to a hypothetical cone used to define features of the blades, in an aft view of the propeller. In this view, the blade 2 is shown with its radial axis 12 perpendicular to, and/or coplanar with the hub axis, and as mentioned in relation to FIG. 1, disposed on the same generator line that defines the blade thrust surface 8. This is an aft view, looking at the thrust surface of the blades. As shown in both FIGS. 6 and 7 the vertex of the reference cone is spaced from the propeller axis, and is located opposite the propeller axis relative to each blade. The vertex of the reference cone is spaced from the axis of rotation, and is on the opposite side of the axis of rotation from each blade. The vertex of the reference cone may be spaced from the propeller axis by a distance equal to half the length of a greatest distance from the blade root to the blade tip as measured along the generator line that passes through the axis of rotation and up to approximately the length said greatest distance from the blade root to the blade tip.

Additionally it is preferable that the axis of rotation be sufficiently remote from the vertex of the cone to allow the blade root to be wide enough for structural strength without excessive curvature. FIGS. 6 and 7 illustrate a form of propeller blade whose reference cone is a 90° right circular cone and whose thrust surface conforms to the cone's curvature remote from the cone's vertex such that the blade's axis of rotation intersects a generator line at a distance of at least half the length of the distance from the blade root to tip as measured along the generator line that passes through the axis of rotation (FIG. 7), and up to approximately the length of the blade's radial axis away from the cone's vertex (FIG. 6) or more (FIG. 2). Thus, the blade's axis of rotation intersects a generator line at a distance from the vertex of the reference cone of between half the length of a greatest distance from the blade root to the blade tip as measured along the generator line that passes through the axis of rotation and up to approximately the length said greatest distance from the blade root to the blade tip.

The blade covers 90° or less of the circumference of the cone (the circumference of the cone, along a plane parallel to the base) or, correspondingly, less than a quarter cone, as determined by the angle between two generator lines of the cone that do not intersect the blade. Preferably, the axis of rotation and generator line through it are at right angles to each other.

The reference cones of FIGS. 6 and 7 are characterized by a circumference, defined as the circular arc created by intersection of a plane perpendicular to the vertical axis 24 of the cone. The circumference of the cone varies with distance from the vertex. Preferably the blade subtends 90° or less of the reference cone circumference as illustrated in FIG. 7, i.e. covers a quarter cone or less of the reference cone circumference, more preferably 45° or less, or one eighth cone, as determined between two generator lines on the edges of the blade. Wider coverage of the cone's surface rotates the fluid and thus is inefficient. An angle whose vertex lies on a plane perpendicular to the axis of rotation at a point where it intersects the thrust surface, and on an imaginary cylinder concentric with the axis of rotation, with one side of the angle in the plane of rotation and perpendicular to the radius, and the other side tangent to the imaginary cylinder at the point of intersection with the thrust surface, preferably should be 90° or less apart from any other such angle at the same radius on the thrust surface, more preferably 45° or less. Thus, at all radiuses along the length of the blade the blade has a width that is 90° or less of the circumference of the reference cone at the height on the reference cone corresponding to that radius along the length of the blade. Thus, at a first radius along the length of the blade, the blade has a width that is 90° or less of the circumference of the reference cone at a height on the reference cone corresponding to that radius along the length of the blade, and at no second radius along the length of the blade is the width greater than 90° of the circumference of the reference cone at a height on the reference cone corresponding to that second radius.

As described above, the propeller comprises a hub operable to rotate about an axis of rotation in a direction of rotation, characterized by a forward end and an aft end, and one or more of the blades each characterized by a root, a tip, a leading edge and a corresponding trailing edge, and a thrust surface. The thrust surface of each blade conforms to a surface of a reference cone characterized by a vertex and a base, and a generator line, wherein a radial axis extending radially from the root of the blade to or toward the tip area of the blade corresponds to a generator line of the reference cone, and the root of the blade is fixed to the hub such that the axis of rotation lies in the same plane as the radial axis of the blade. The axis of rotation and the radial axis of the blade may be substantially perpendicular or set at an angle of 45° or more. Correspondingly, the plane of rotation perpendicular to the axis of rotation may be substantially parallel or set at an angle of 45° or less either forward or aft (a rake angle). The leading edge of each blade is forward of its corresponding trailing edge. The average pitch angle between the leading and trailing edges may be 45° or less. The pitch angle may increase from leading to trailing edge, and decrease from root to tip.

As a result of the relationship between the hub and blade, a line on the thrust surface, along the axis of the blade, is a straight line corresponding to a generator line of the cone, and the shape of the blade thrust surface, along a leading-to-trailing line perpendicular to the vertical axis of the reference cone, is a circular arc. Where the hub is displaced from the vertex of the reference cone, as shown in FIGS. 2, 6 and 7, there may be only a single straight line corresponding to a generator line of the cone on the thrust surface that goes through the hub. The shape of the blade thrust surface, along a leading-to-trailing line perpendicular to the reference cone vertical axis, where the reference cone is a right cone, is a circular arc.

In terms of the reference cone, the blade is disposed with respect to the hub axis so that a plane containing the propeller axis (that is, the propeller axis lies in that plane) will also contain a generator line (that is, the generator line lies in that plane) of the cone which corresponds to a long axis of the blade, such that the blade may have circular or conical curvature in transverse directions, across the thrust surface, between the leading and trailing edges of the blade and substantially no curvature in a direction radial of the blade. The blades may be non-raked, such that the generator line of the cone is perpendicular to the hub axis, or raked such that it is angled relative to the hub axis such that the tip of the blade is forward or aft of the root of the blade. The blade back of each blade may have various curvatures, for example to create an airfoil cross section of the blade to increase suction. Each blade may be sharpened, chamfered or faired on its edges, or thickened, strengthened, or faired at or near its hub or boss.

Figure 8:
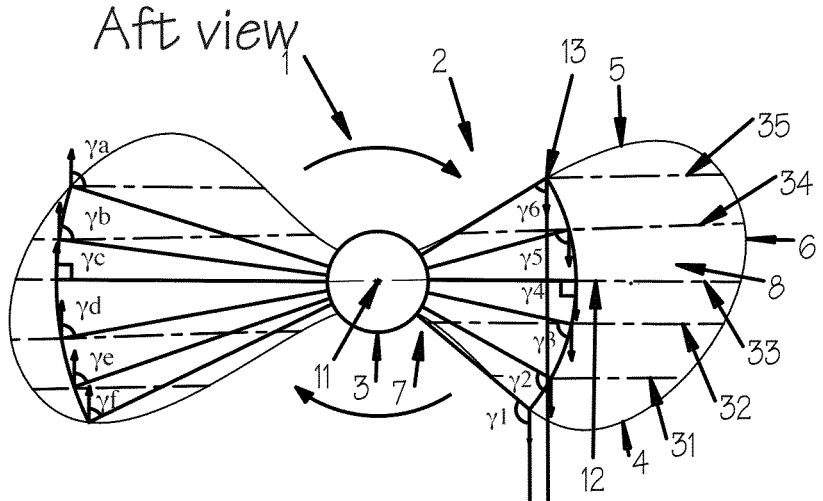
FIGS. 8 and 8A illustrate the form of the propeller blades in relation to fluid flow induced by the propeller.
Figure 8A:
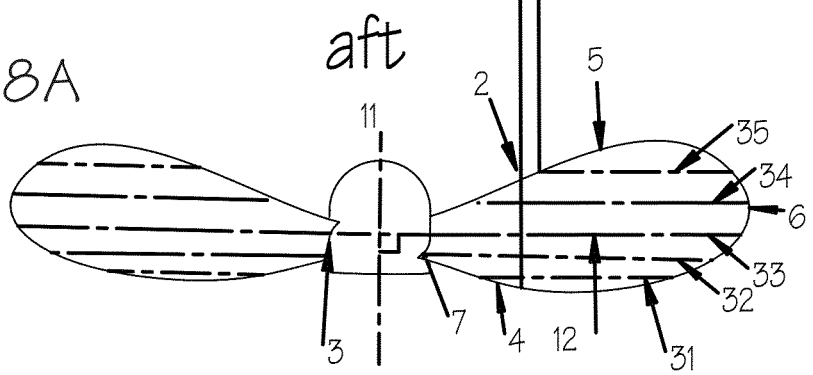
Figure 9:
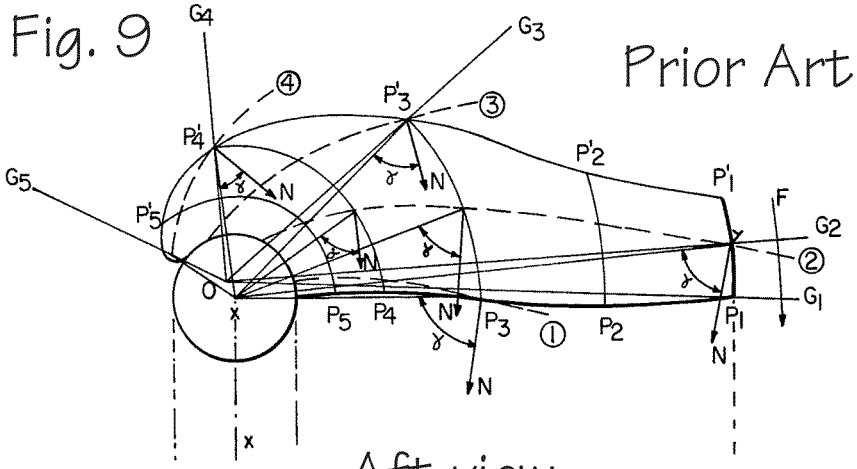
FIG. 9 illustrates a prior art propeller blade.

FIGS. 8 and 8A illustrate the form of the propeller blades in relation to fluid flow in the plane of rotation induced by the propeller, while FIG. 9 illustrates a prior art propeller. FIG. 8 shows the propeller 1 with blades as described above, including one of the blades 2, the hub 3, showing the leading edge 4, the trailing edge 5, the tip 6, the root 7 and the thrust surface 8. This is an aft view, with the hub axis 11 perpendicular to planes parallel to the page. The leading to trailing line (the pitch line) 13 is also shown, along with the blade center axis 12. The blade shape described in reference to the previous Figures results in gamma angles as shown in FIG. 8. The gamma angle $\gamma$ is the angle between a radial line extending from the hub axis to a point on the blade face, and a line perpendicular to a "transverse plane intersection" line on the thrust surface of the blade (an imaginary line defined by the intersection of a plane, perpendicular to the axis of rotation, with the thrust surface (the whole aft-facing surface). This transverse plane intersection line lies in a plane perpendicular to the axis of rotation. Various transverse plane intersection lines 31 through 35 are shown in FIGS. 8 and 8A, where line 31 is forward of line 32, which is forward of line 33, line 34 and line 35 and so on. The gamma angles are demonstrated at arbitrary points along the face of the blade. As worded in the claims, the gamma angle $\gamma$ is the angle between the radial axis and a vector in the direction of rotation, where said vector is perpendicular to an "intersection" line formed on the blade face by intersection of a plane perpendicular to the axis of rotation, and the vector lies in the intersecting plane. A gamma angle of zero would point directly inward to the hub axis along the radial line, and a gamma angle of 180° would point directly away from the hub axis.

The gamma angle varies along the pitch line 13. At the leading edge, and near the leading edge, as shown in FIG. 8, the gamma angles $\gamma_1$, $\gamma_2$, $\gamma_3$, etc. are obtuse, greater than 90° from the inner segment of the radial line, and the gamma angles gradually decrease toward the trailing edge of the blade, such that the gamma angles $\gamma_5$ and $\gamma_6$, for example, are acute toward and at the trailing edge. Thus, at the leading edge, the gamma angle formed at any given radius from the hub/axis of rotation is greater than 90°, while at the trailing edge, the gamma angle formed at any given radius from the hub/axis of rotation is less than 90°. Along the pitch line, moving from the leading edge to the trailing edge, the gamma angle gradually lessens from obtuse to acute. At a midline, the gamma angle $\gamma_4$ will be 90° (g4 is arbitrarily assigned the subscript 4, merely because it is the fourth, of an infinite number of gamma angles, depicted in the figure). This midline is shown in FIG. 8 as line 33, the blade center axis, along which the gamma angles, such as $\gamma_4$, are 90°. For a blade conforming to the surface of a cone, and a hub axis remote from the reference cone vertex, this blade center axis will be the only line corresponding to a generator line of the reference cone (that is, the only line that will pass through both the hub axis and the vertex of the reference cone). The blade on the left side of FIG. 8 is annotated with gamma angles $\gamma_a$, $\gamma_b$, $\gamma_c$, $\gamma_d$, $\gamma_e$, and $\gamma_f$ which are comparable to the gamma angles $\gamma_1$, $\gamma_2$, $\gamma_3$, etc. shown on the blade on the right side of the propeller.

FIG. 9 represents a prior art propeller blade disclosed in Entat, U.S. Pat. No. 4,135,858, demonstrating the distinguishing aspects of FIG. 8. In FIG. 9, the gamma angles are acute at the leading edge of the blade, and become progressively more acute toward the trailing edge.

Figure 10:
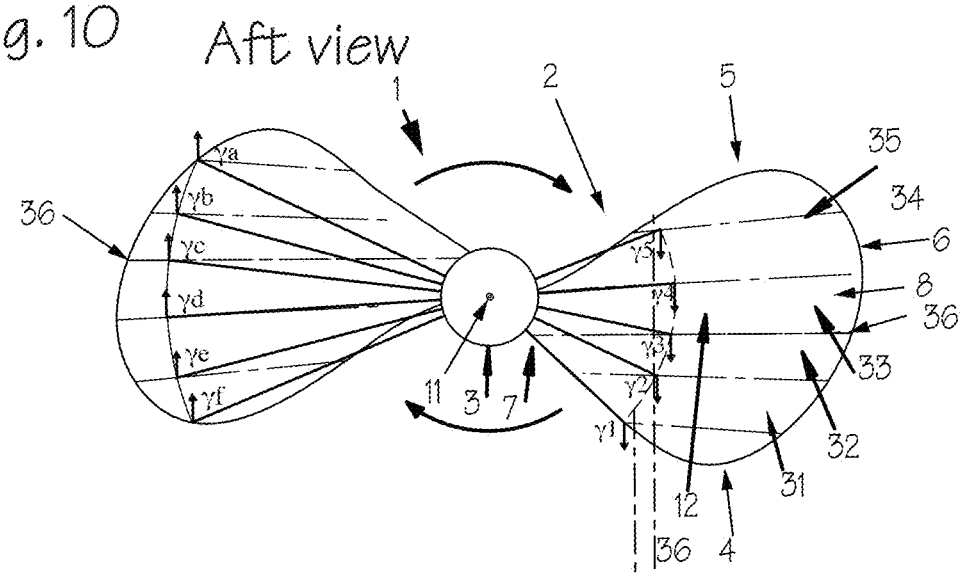
FIGS. 10, 10A, 11 and 11A illustrate forms of the propeller blades wherein generator lines that define the blade thrust surface are substantially perpendicular to the axis of rotation and do not intersect the axis of rotation.
Figure 10A:
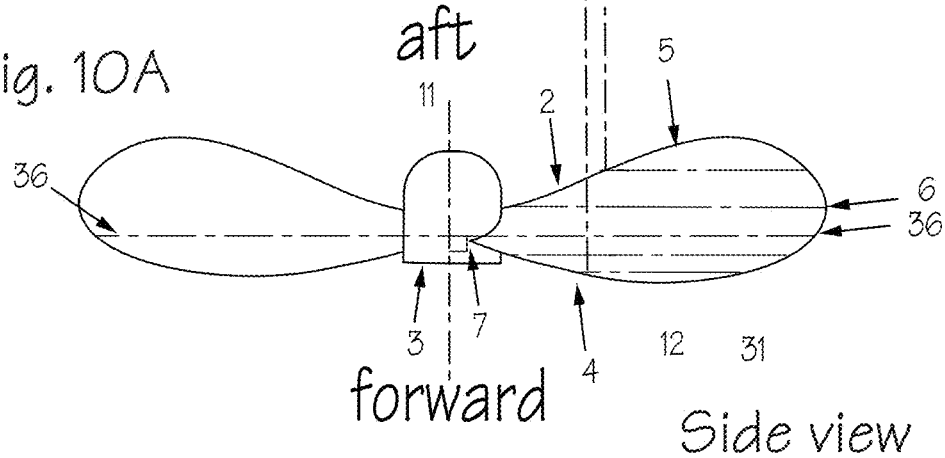

FIGS. 10 and 10A illustrate forms of the propeller blades 2 wherein a generator line 36 that defines the blade thrust surface 8 is substantially perpendicular to the axis of rotation 11. Generator line 36 passes ahead of the axis of rotation 11 relative to the direction of blade rotation, rather than through the axis of rotation 11. The axis of rotation and said perpendicular generator line are not coplanar. The portion of generator line 36 that lies on the blade thrust surface is located between the forwardmost point of the leading edge 4 and the aftermost point of the trailing edge 5 and has obtuse gamma angles ($\gamma_3$, $\gamma_c$). Gamma angles on the thrust surface in FIGS. 10 and 10A transition from obtuse ($\gamma_1$, $\gamma_a$) at the leading edge 4 to acute ($\gamma_f$) at the trailing edge 5.

Figure 11:
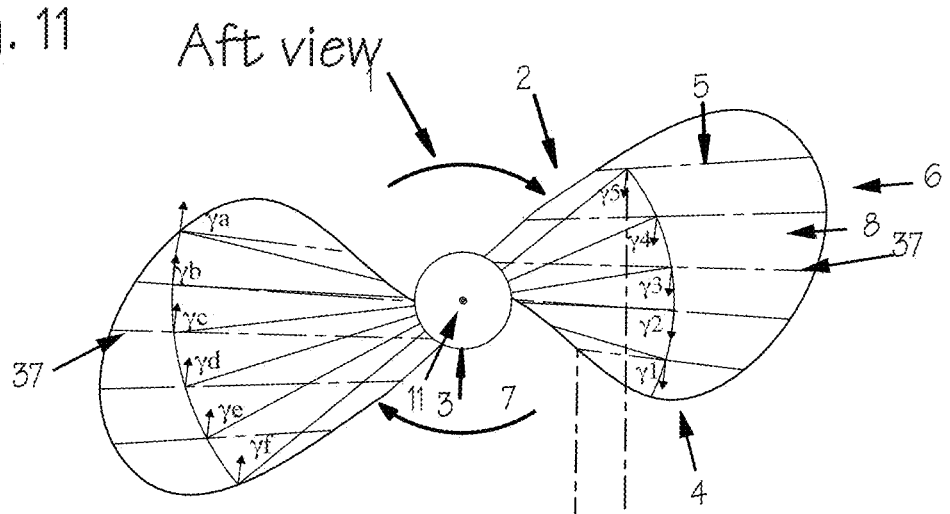
Figure 11A:
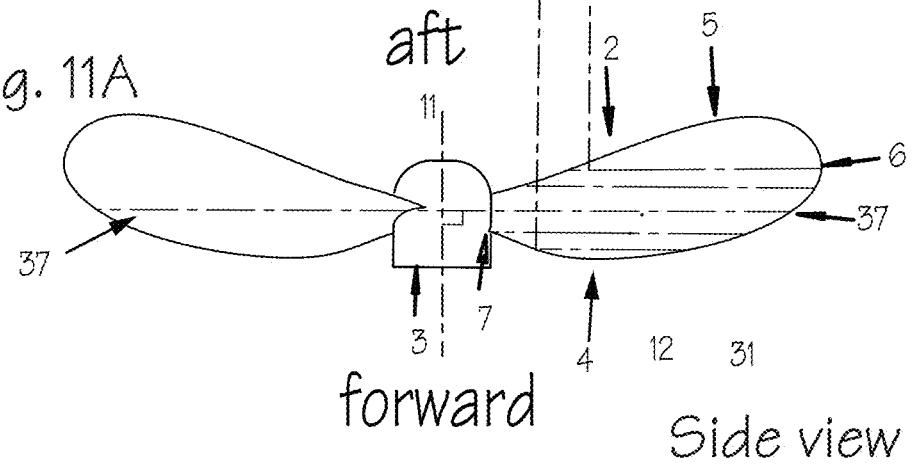

FIGS. 11 and 11A illustrate forms of the propeller blades 2 wherein a generator line 37 that defines the blade thrust surface 8 is substantially perpendicular to the axis of rotation 11. Generator line 37 passes behind the axis of rotation 11 relative to the direction of blade rotation, rather than through the axis of rotation 11. The axis of rotation and said perpendicular generator line are not coplanar. The portion of generator line 37 that lies on the blade thrust surface is located between the forwardmost point of the leading edge 4 and the aftermost point of the trailing edge 5 and has acute gamma angles ($\gamma_3$, $\gamma_c$). Gamma angles on the thrust surface in FIGS. 11 and 11A transition from obtuse ($\gamma_1$, $\gamma_a$) at the leading edge 4 to acute ($\gamma_f$) at the trailing edge 5.

The vertices of the reference cones in FIGS. 10, 10A, 11 and 11A, are located between planes perpendicular to the axis of rotation that contain the forwardmost point of the leading edge 4 and the aftermost point of the trailing edge 5, respectively. Thus, generator lines 36 and 37 can be perpendicular to the axis of rotation 11 while passing through their reference cone vertices. In contrast, Entat's reference cone vertex is above the leading edge, resulting in generator lines angled upstream, and a blade that rotates the medium.

Figure 12:
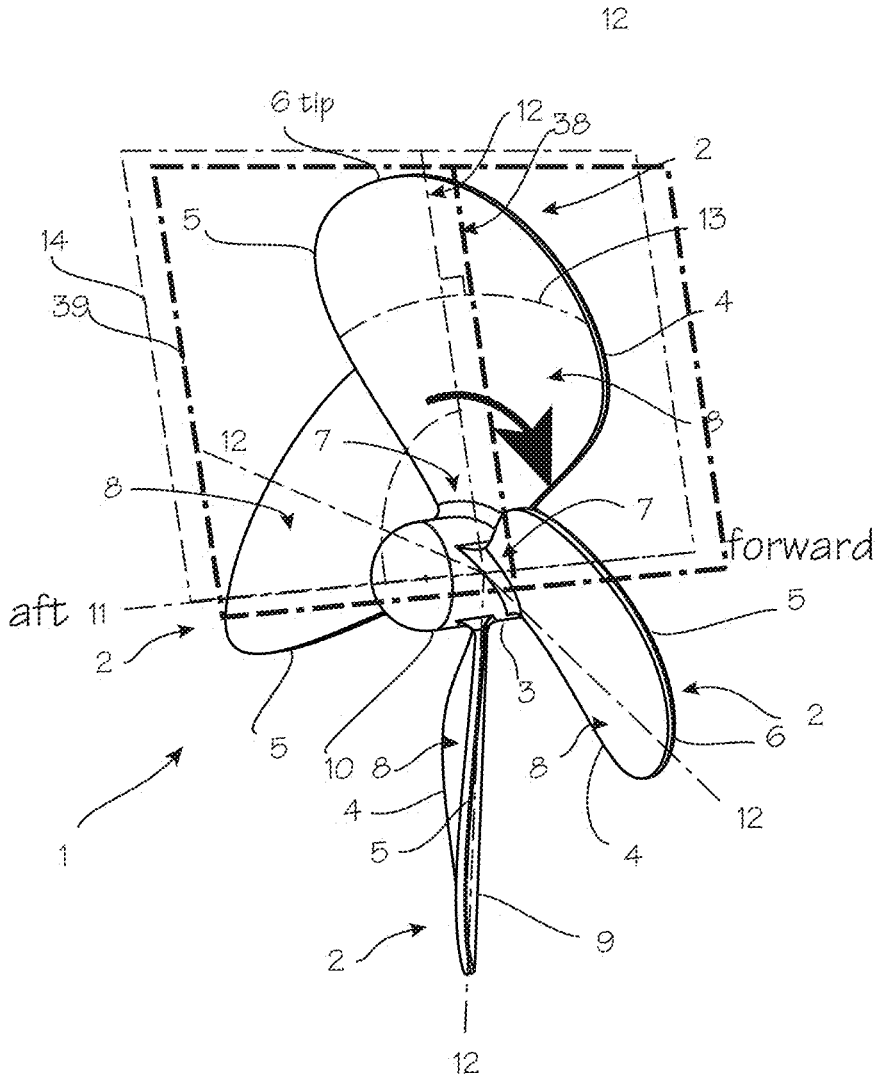
FIGS. 12 and 13 illustrate a definition of shifting of generator lines ahead of the axis of rotation 11 relative to the direction of blade rotation and behind the axis of rotation 11 relative to the direction of blade rotation used in reference to FIGS. 10, 10A, 11 and 11A.
Figure 13:
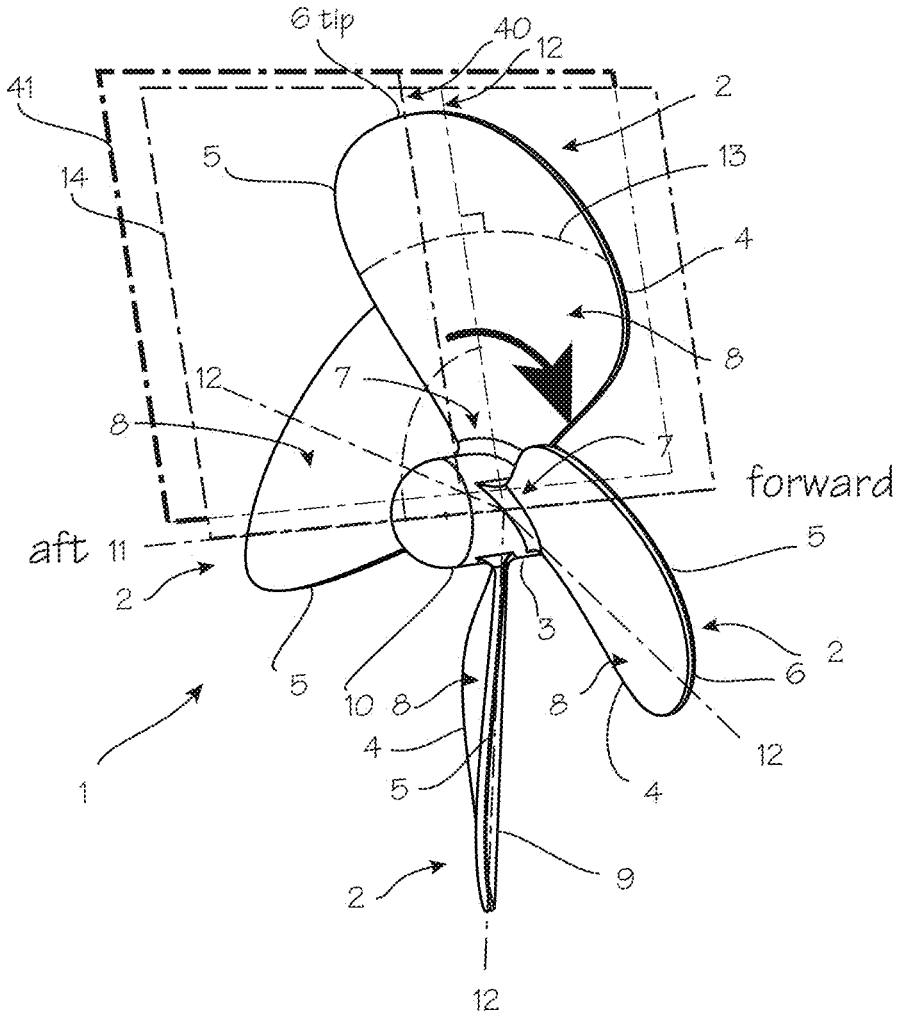

"Forward of the axis of rotation relative to the direction of blade rotation" means displaced toward the leading edge, along the entire length of the generator line, as illustrated in FIG. 12, where the forward shifted generator line 38 lies in a plane 39 parallel to plane 14, which was established in relation to FIG. 1, and was defined as a plane defined by the hub axis 11 and the blade center axis 12 which in turn is a generator line of reference cone intersecting the hub axis. Generator line 38 and plane 39 do not intersect the hub axis. "Aft of the axis of rotation relative to the direction of blade rotation" means displaced toward the trailing edge, along the entire length of the generator line, as illustrated in FIG. 13, where the aft shifted generator line 40 lies in a plane 41 parallel to plane 14, which was established in relation to FIG. 1, and was defined as a plane defined by the hub axis 11 and the blade center axis 12 which in turn is a generator line of reference cone intersecting the hub axis. Generator line 40 and plane 41 do not intersect the hub axis.

Figure 14:
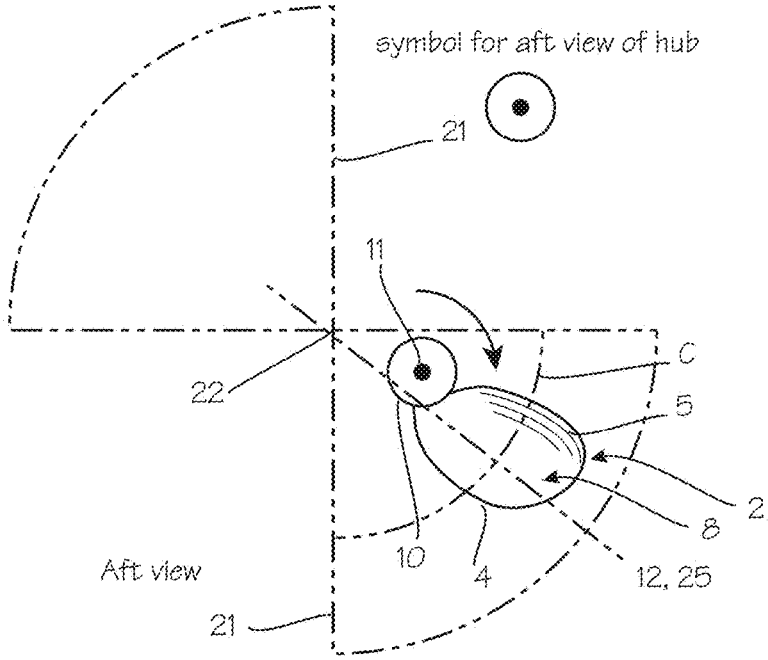
FIGS. 14 and 15 represent the change in relative position of the hub and blade for the propellers illustrated in FIGS. 10, 10A, 11 and 11A in comparison to the propellers illustrated in FIGS. 7 and 8.
Figure 15:
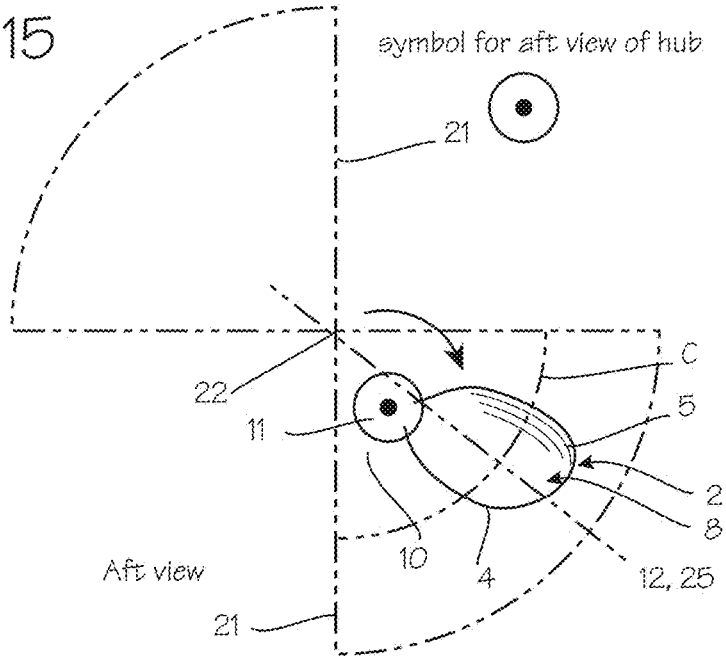

FIG. 14 represents the change in relative position of the hub and blade for the propellers illustrated in FIGS. 10 and 10A in comparison to the propellers illustrated in FIGS. 7 and 8. FIG. 15 represents the change in relative position of the hub and blade for the propellers illustrated in FIGS. 11 and 11A in comparison to the propellers illustrated in FIGS. 7 and 8. In FIG. 14, the generator line 25 is forward of the axis of rotation relative to the direction of blade rotation, and the hub axis 11 is, correspondingly, disposed aft of the generator line relative to the direction of blade rotation. In FIG. 15, the generator line 25 is aft of the axis of rotation relative to the direction of blade rotation, and the hub axis 11 is, correspondingly, disposed forward of the generator line relative to the direction of blade rotation.

Though the inventions have been illustrated with four-bladed marine propellers, the propeller may be made with any plurality of blades (or even a single blade), and may be adapted for aeronautical use. The description above has been provided in reference to right-hand propellers (rotating clockwise when viewed from aft), but the same principles apply to left-hand propellers.

If the axis of rotation is at 90 degrees to the generator line that runs through it, and the reference cone vertex angle is 90 degrees, planes parallel to the axis of rotation will cut the reference cone and blade along parabolic lines, irrespective any twist of the blade around the generator line. Thus, blades based on 90-degree reference cones with axes of rotation perpendicular to the generator line through them are often preferred.

If the axis of rotation is at 90° to the generator line through it, and the reference cone vertex angle is acute, planes parallel to the axis of rotation will cut the reference cone and blade along elliptical lines. If the axis of rotation is at 90° to the generator line through it, and the reference cone vertex angle is obtuse, planes parallel to the axis of rotation will cut the reference cone and blade along hyperbolic lines.

Blades with a generator line through the hub as the blade center axis will have gamma angles that transition from obtuse to acute across the blade (from the leading edge to the trailing edge). These blades are advantageous because their gammas are open to receive the flow at the leading edge and accelerate the flow axially downstream as the gamma angles narrow, while the straight blade center axis improves structural strength and balance.

Figure 16:
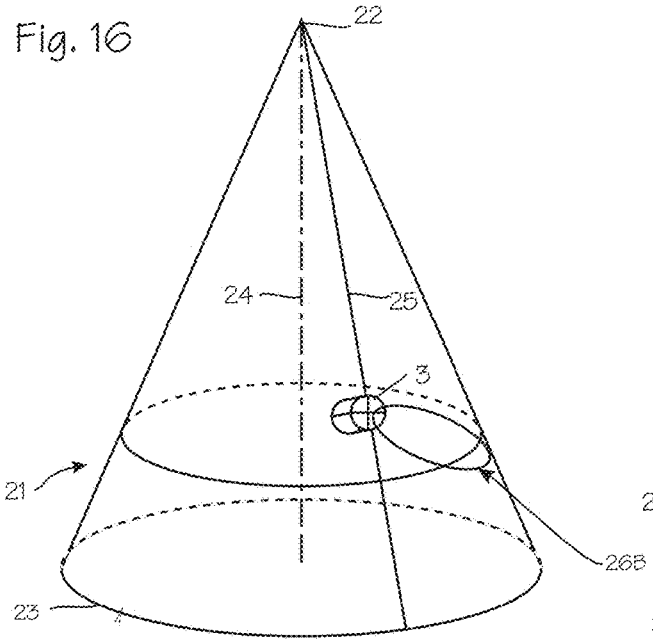
FIGS. 16, 17 and 18 illustrate a second form of the propeller blades in relation to the hypothetical cone used to define features of the blades, from a forward perspective.

FIG. 16 illustrates a second form of the propeller blades in relation to a reference cone used to define features of the blades, from a forward perspective. As with FIG. 2, the reference cone 21 is characterized by a vertex (apex) 22, a round (preferably circular) base 23, a vertical axis 24 and any number of generator lines exemplified by generator line 25. The cone may be a right cone (the vertical axis 24 passes through the center of the circular base at a right angle), or an oblique cone with a circular or elliptical base, though a right circular cone is preferred because it can provide parabolic curvature on the blade surfaces. In reference to the reference cone, the thrust surface of the blade conforms to a section of the reference cone, such as section 26B, which is not centered on the generator line 25 which passes through the hub axis 11 (compare this with area 26 in FIG. 2) and is not intersected by the generator line which passes through the hub axis 11 which establishes the radial axis 12 of the blade shown in FIG. 1.

In the blade shown in FIG. 16 to 20, the blade center axis, or radial axis, does not lie on the generator line that goes through the axis of rotation of the propeller, as it does in versions of the blades described in relation to earlier figures.

The hub 3 is shown in relation to the reference cone, intersecting the surface of the cone and centered on the generator line 25 which does not pass through the root of the blade and, preferably, does not pass through section 26B of the reference cone (and thus, does not pass through the blade conforming to section 26B). Thus, as shown in FIG. 16, a generator line of the cone intersecting the axis of rotation does not intersect the root of the blade. Also, the generator line of the cone intersecting the axis of rotation does not intersect any portion of the blade. (Some minor intersection near the root of the blade (including portions of the blade near the root that do not conform to the reference cone (such as portions thickened to strengthen the joint) may be acceptable, while still obtaining the parameters described in the following figures.)

Figure 17:
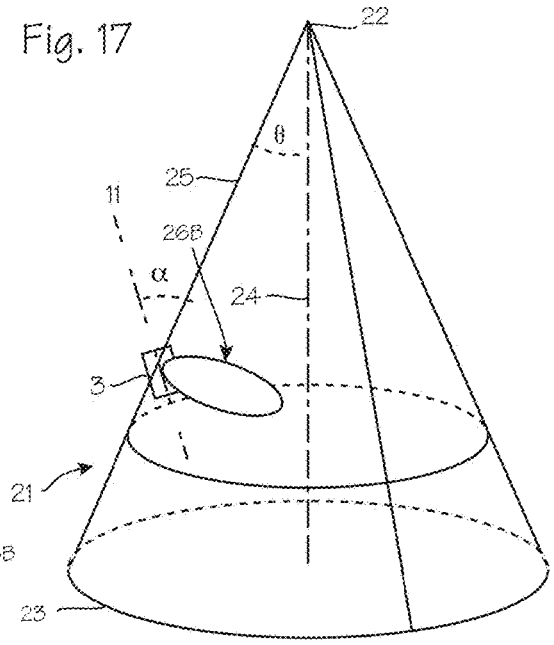

As shown in FIG. 17, the hub axis is preferably angled (up and down) relative to the generator line 25.

The hub axis 11 forms an acute angle α (alpha) with the portion of its generator line between the intersection of the hub axis with the generator line and the apex 22 of the reference cone. The complementary angle between the hub axis and the portion of its generator line between the intersection of the hub axis with the generator line and the base of the reference cone is obtuse. The angle α (alpha) may correspond to the apex angle of the reference cone (illustrated as about double the apex angle θ (theta)) in these drawings or fall within the range of 5 to 60°, or more preferably fall within the range of 10 to 45° and even more preferably fall within the range of 15 to 30°.

As mentioned in relation to FIGS. 3, 4 and 5 the blade outlines used in conjunction with the propeller conforming to FIG. 16 may be elliptical as shown in FIG. 3, circular as shown in FIG. 4, or wedge shaped, with straight leading and trailing edges and a straight-cut tip as shown, in FIG. 5, all distinguished from FIGS. 3, 4 and 5 in that the generator line which passes through the hub axis does not pass through the blade and/or that the orientation of the hub axis is altered to change the gamma angles on the blade. The blade outline may be slightly or highly skewed, arc-tipped, scimitar-shaped, or any other shape that provides thrust.

Figure 19:
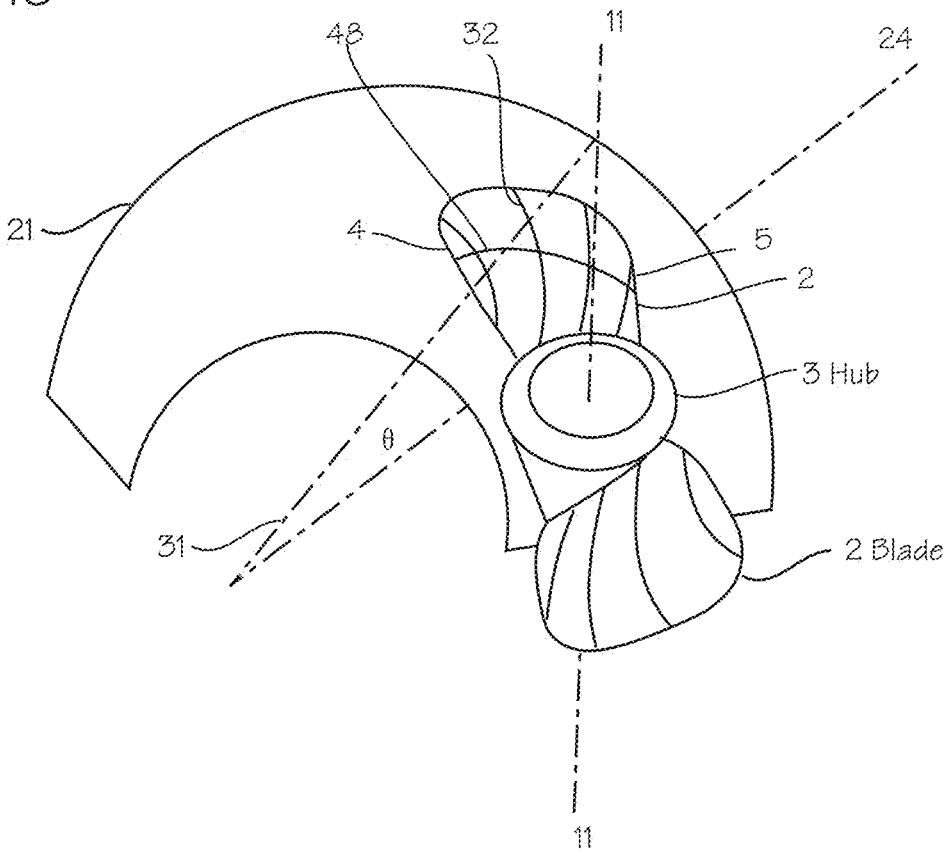
FIG. 19 provides an additional view of the hub and blade and the reference cone of FIG. 16.

FIG. 19 provides an additional view of the hub 3 and blade 2 and the reference cone 21. This view, from above the cone, shows the blade 2 conforming to the surface of the reference cone, with the hub axis 11 intersecting the surface of the reference cone at a non-perpendicular angle, such that the hub axis 11 does not intersect the cone vertical axis 24. The generator line 42 is one of many generator lines defining the thrust surface of the blade, and defines a corresponding straight path over the thrust surface. Also, this illustration depicts the embodiment in which no generator line passes through both the hub axis and the blade.

Thus, the hub axis is also leaning, relative to the external surface of the reference cone, toward the second generator line 42 shown in FIG. 19. The hub axis intersects the cone surface (that is, it is not tangent to the cone surface).

Figure 20:
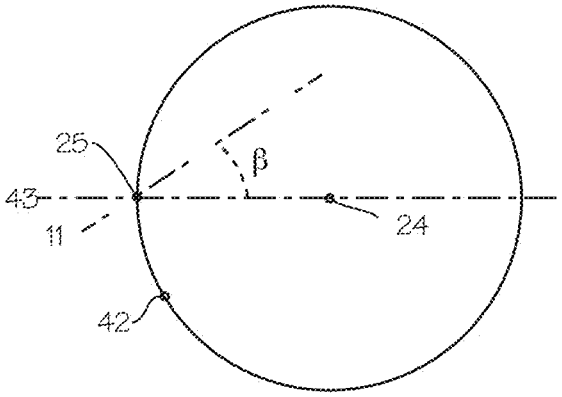
FIG. 20 illustrates features of FIG. 19 in a cross-sectional view of the reference cone.

FIG. 20 illustrates this aspect of this variation of relationship between the hub axis and the reference vertical axis. FIG. 20 is a cross-section of the reference cone, at the level of the intersection of the hub axis with the reference cone (item 47 in FIG. 18). This is a view looking along the 24 axis of the cone (a horizontal cross section of the cone, at the level where the hub axis intersects its corresponding hub axis generator line (item 47 in FIG. 18)), in which the generator line 25 passing through the hub axis and a generator line 42 passing through the blade are depicted as dots.

As shown in FIG. 20, the hub axis 11 is tilted toward the generator line 42 (toward the blade) and away from axis of the cone 24. This tilt is unambiguously defined in reference to the plane 43 in which both the vertical axis 11 and the hub axis generator line 25 lie. The hub axis 11 diverges from this plane at an angle β (beta), which is an angle on the side of the plane nearest the blade generator line(s) 42 (which pass over the blade thrust surface) and outside the cone (the vertical angle on the side of the plane opposite the blade generator line(s) 42 (which pass over the blade thrust surface) and inside the cone is also β (beta)). β (beta) is thus an acute angle, preferably in the range of 30 to 75 degrees, for generator lines defining the thrust surface.

Figure 21:
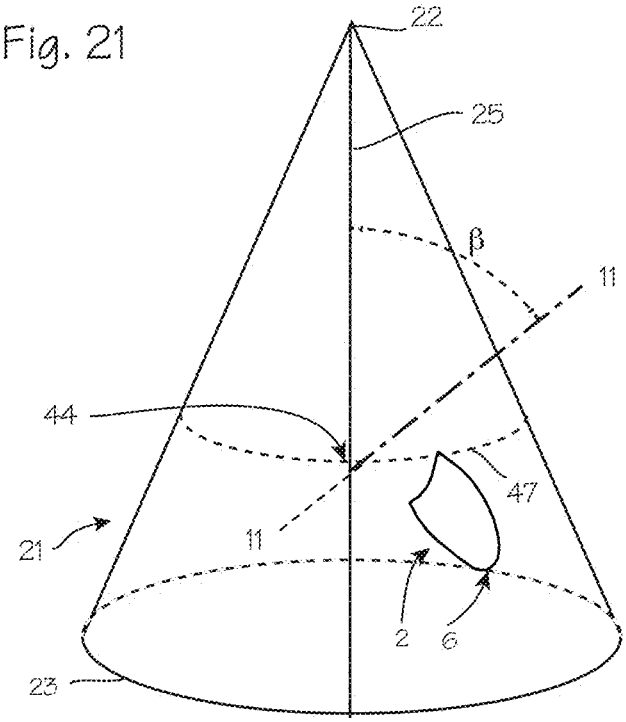
FIG. 21 provides an addition depiction of features of FIG. 19.

FIG. 21 provides an additional depiction of β (beta). As shown in FIG. 21, the hub axis 11 leans toward the blade 2, and is angled from the generator line through which it passes, at an angle β (beta) which is acute (relative to the cone surface between the hub axis generator line and generator line 42 which passes over the blade surface, as shown in FIG. 20). This view, from a side of the cone, shows the blade 2 conforming to the surface of the reference cone, with the hub axis 11 intersecting the surface of the reference cone (at point 44) at a non-perpendicular angle, such that the hub axis 11 does not intersect the cone vertical axis 24 (see FIG. 20). The generator line 42 is one of many generator lines defining the thrust surface of the blade, and defines a corresponding straight path over the thrust surface. As with FIG. 20, this illustration depicts the embodiment in which no generator line passes through both the hub axis and the blade.

The hub axis may also be angled relative to the hub axis generator line while also intersecting the vertical axis 24 (this alters the blade angle). The hub axis 11 may be oriented perpendicular to the surface of the reference cone so that it intersects the generator line 25 at a right angle and also intersects the vertical axis 24 (at an angle dependent on the vertex angle).

The hub axis may instead be angled relative to the surface of the cone (left or right about the generator line) while intersecting the generator line 25 at a right angle, in which case the hub axis 11 will not intersect the cone vertical axis 24, and may still remain perpendicular (but not coplanar) to generator lines passing through the blade. Thus, the hub axis 11 may intersect the generator line 25 at a right angle, or at an acute or obtuse angle relative to generator line 25 and/or the thrust surface of the blade or corresponding section of the reference cone. (Correspondingly, the resulting blade may be raked forward or aft on the hub.) Also, the hub axis may intersect the vertical axis 24 (lie in the same plane) or depart from the plane of the vertical axis. (Correspondingly, the resulting blade will be angled or rotated about the blade center axis relative to the hub axis). Thus, though generator lines such as generator line 25 intersect the hub axis 11, section 26B is selected such that generator line 25, which intersects the hub axis, does not intersect the section 26B (or the blade conforming to section 26B), or intersects the section 26B only in areas of the thrust surface near the hub.

Referring again to FIG. 18, this figure illustrates additional aspects of a propeller according to FIGS. 16 and 17 that may be employed to provide additional efficiency for the propeller. In this illustration, the hub axis intersects its corresponding generator line at a point 44 on the generator line that is closer to the apex than is the thrust surface of the blade. The blade is angled downwardly, relative to the reference cone, such that the blade tip is located farther from the apex of the reference cone than is the point 44 at which the hub axis intersects its corresponding generator line. This can be expressed by the relationship of line 45 (the blade center axis) passing through the point 44 and the tip of the blade. The line 45 represents a plane cut (such as plane 46 containing point 44 (the point at which the hub axis intersects its corresponding generator line) and a point on the tip 6 of blade. An angle δ (delta) between the generator line 25 and line 45 is obtuse, and is preferably in the range of 90K to 150°, and more preferably in the range of 120 to 150°. A related angle ϕ (phi) between a horizontal plane cut 47 (intersecting the axis of rotation) and the line 45, or a blade center axis, is acute, in the range of 30 to 60 degrees. A blade with advantageous degree twist can be achieved by forming the blade according to FIG. 18 where plane 46 is parallel to a single generator line of the cone (the generator line opposite generator line 25, and thus line 45 (a blade centerline) is a parabolic curve on the face of the blade. For a right angle cone, choosing $\phi$ (phi) to be complimentary to $\theta$ (theta) (the apex angle), on the curved surface of the cone, will result in a parabolic curve along line 45. Alternatively, for a right angle cone, choosing $\delta$ (delta) to be supplementary to $2\times\theta$ (theta) (the apex angle), on the curved surface of the cone, will result in a parabolic curve along line 45.

Figure 18:
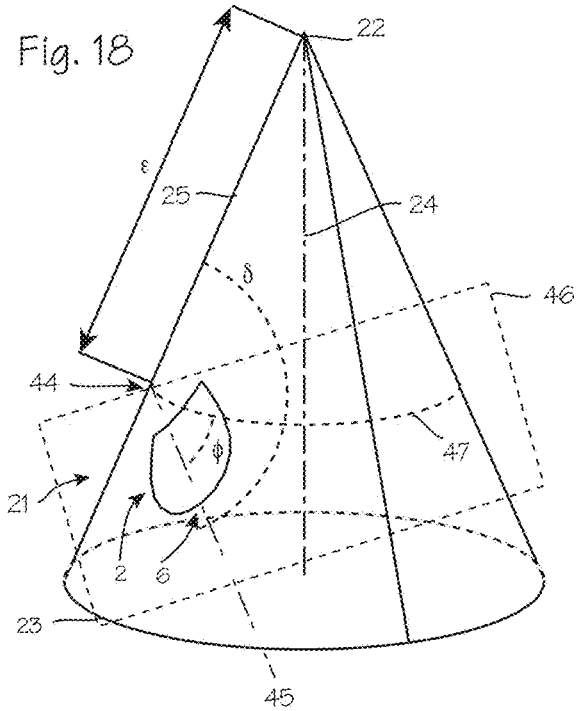
Figure 22:
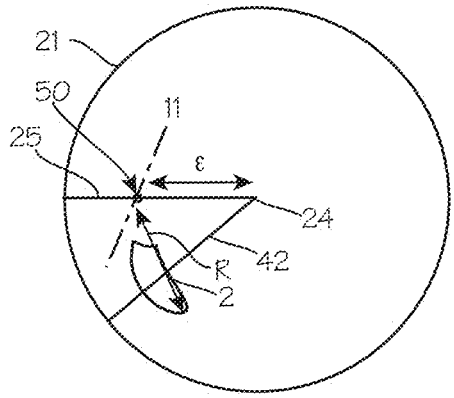
FIG. 22 illustrate features of FIG. 19 in a cross-sectional view of the reference cone.

As described in relation to the earlier figures, the hub 3 and hub axis 11 are preferably displaced from the vertex of the reference cone at a distance depending on the radius of the propeller. As illustrated in FIG. 18 and FIG. 22, the radius R of the propeller (the distance from the hub axis to the farthest point on the tip of the blade) and the distance $\varepsilon$ (epsilon) between the cone apex 22 is such that the radius R is equal to one-half to one-quarter of the (25% to 50%) of the apex-to-hub axis $\varepsilon$ (epsilon). FIG. 22 is a top view of the reference cone, with an outline of a blade 2 and lines representing the hub axis generator line 25 and one of the many generator lines 42 defining the thrust surface of the blade.

Figure 23:
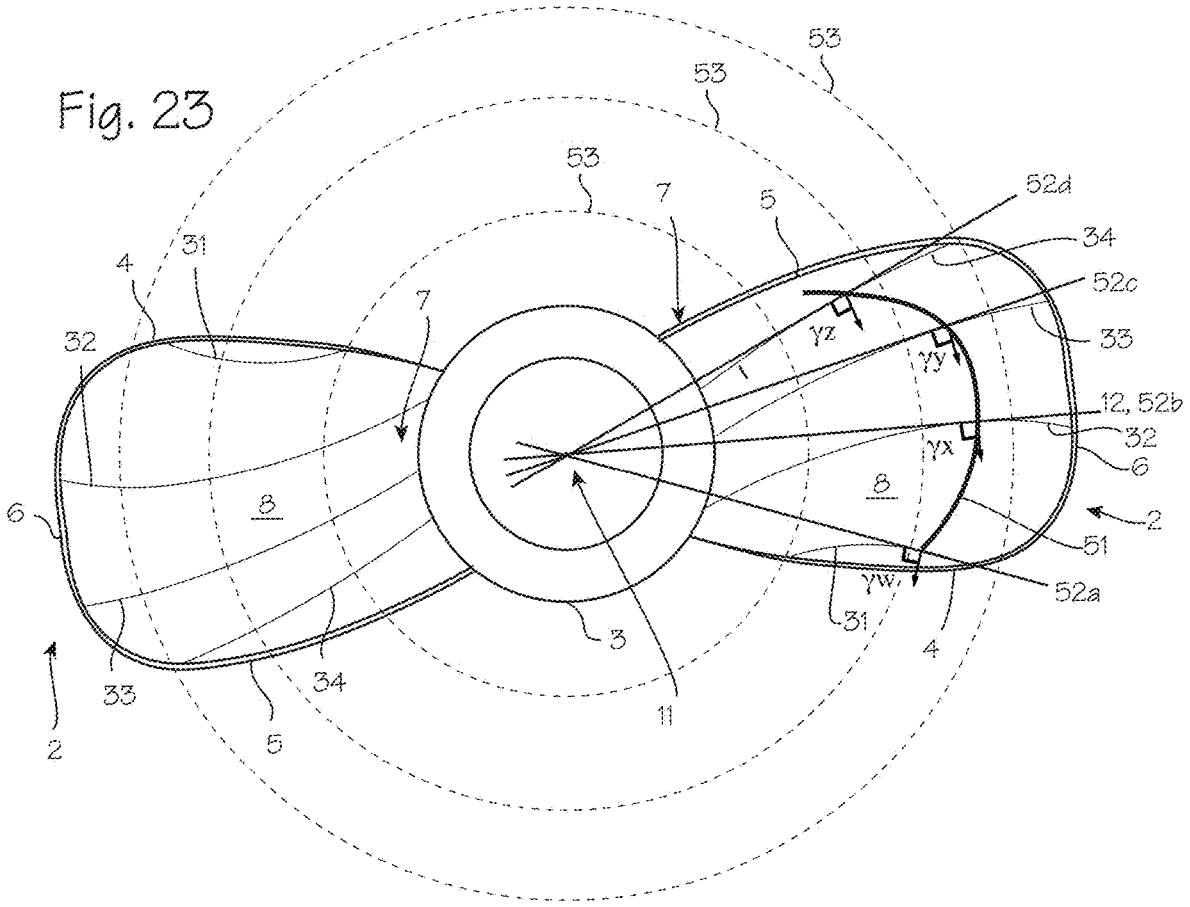
FIG. 23 illustrates the form of the propeller blades in relation to fluid flow in the plane of rotation induced by the propeller, for comparison with FIG. 8A.

FIG. 23 illustrates a form of the propeller blades in relation to fluid flow in the plane of rotation induced by the propeller, for comparison with FIGS. 8 and 8A. This FIG. 23 includes the blades 2, the hub 3, showing the leading edge 4, the trailing edge 5, the tip 6, the root 7 and the thrust surface 8. This is an aft view, in which the hub axis 11 is perpendicular to planes parallel to the page. The blade shape described in reference to the previous FIGS. 16 and 17 results in gamma angles $\gamma$ as shown in FIG. 23. These transverse plane intersection lines lie in a plane perpendicular to the axis of rotation. Various transverse plane intersection lines 31, 32, 33, and 34 are shown in FIG. 23, where line 31 is forward of line 32, which is forward of line 33, and so on. The gamma angles $\gamma$ are demonstrated at points along the face of the blade. The gamma angle $\gamma$ is the angle between a radial line extending from the hub axis to a point on the blade face, and lines perpendicular to a "transverse plane intersection" line on the thrust surface of the blade (an imaginary line defined by the intersection of a plane, perpendicular to the axis of rotation, with the thrust surface (the whole aft-facing surface)). A gamma angle of zero would point directly inward to the hub axis along the radial line, and a gamma angle of 180° would point directly away from the hub axis.

In the blade conforming to FIGS. 19, 20 and 23, the gamma angle remains at a right angle along line 51. The line 51 is established by the point at which radial lines 52*a, b, c* and *d* are tangent to exemplary plane intersection lines 31, 32, 33, and 34. These plane intersection lines correspond to intersections of planes 53 (the phantom circles) perpendicular to the hub axis with the blade. The specific shape of these lines is dependent on the location of the blade on the reference cone and the tilt of the hub axis relative to the generator line on which it lies and the tilt of the hub axis relative to the axis of the reference cone.

As shown in FIG. 23, along the line 51 the gamma angles $\gamma_w$, $\gamma_x$, $\gamma_y$ and $\gamma_z$, etc. are right angles, and the gamma angles may remain at 90° toward the trailing edge of the blade (depending on the area of the reference cone and the angle of the hub axis relative to its generator line). Along the line 51, moving from the leading edge to the trailing edge, the gamma angles remain at 90°, including at the midline (this midline may correspond to line 52*b*, and may be the blade center axis), which, for a blade conforming to the surface of a cone, and a hub axis remote from the reference cone vertex, and no generator line passing through the blade, will not correspond to a generator line of the reference cone). The shape and location of line 51 is dependent on the location of the blade on the reference cone and the tilt of the hub axis relative to the generator line on which it lies and the tilt of the hub axis relative to the axis of the reference cone. Inside this line (closer to the hub) gamma angles are obtuse, and outside this line, gamma angles are acute. This line 51 is an arc which is concave relative to the hub axis, with the point furthest from the hub axis disposed near the blade center axis, and the curve arching inwardly toward the hub toward both the leading edge and trailing edge. This arc is preferably located within 10% and 90% of a blade radius from the hub.

Figure 24:
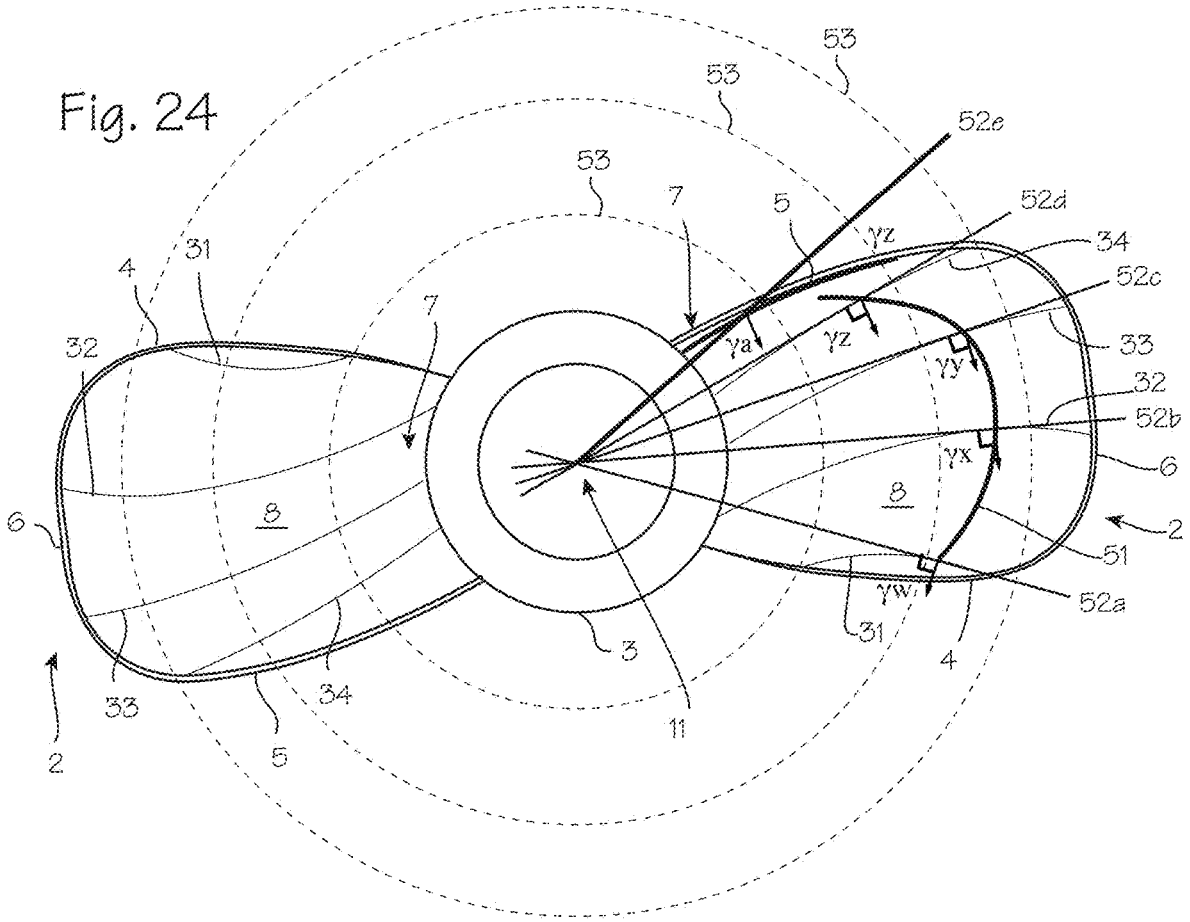
FIG. 24 illustrates a characteristic of the propeller which may be achieved by arranging the axes to achieve a trailing edge region with acute gamma angles.

FIG. 24 illustrates a characteristic of the propeller which may be achieved by arranging the axes as shown in FIGS. 16 through 19. As shown in FIG. 24, the blade thrust surface conforms to a surface of a cone, and includes an arc 51 spanning the blade from the leading edge toward the trailing edge along which the gamma angle is 90 degrees, excepting an area of the thrust surface proximate the hub and proximate the trailing edge in which all gammas are acute (such as angle $\gamma_a$ along radial line 52*e*, where it intersects a plane intersection line near the trailing edge. This is achieved by choosing the blade parameters as described above. Also, the blade may have an area of the thrust surface proximate the hub and proximate the leading edge in which all gammas are obtuse.

Thus, the propeller according to FIGS. 16, 17 and 19 comprises a hub characterized by a hub axis and an axis of rotation, one or more blades characterized by a root, a tip, a leading edge and a corresponding trailing edge, and a thrust surface. For each of the blades the blade thrust surface conforms to a surface of a reference cone characterized by a vertex, a base, a vertical axis, and a plurality of generator lines. In reference to the reference cone, the hub axis intersects a first generator line of the reference cone, and the blade thrust surface contains a straight path over the thrust surface corresponding to a second generator line. In the preferred embodiment the hub axis does not intersect the vertical axis. Also, the hub axis is preferably set at an acute angle to the first generator line, but in other embodiments may be perpendicular to the first generator line. The hub axis is preferably tilted relative to the first generator line, such that it is not perpendicular to the straight path which corresponds to the second generator line, which will alter the shape of the line 51 and the location of acute and obtuse gammas over the surface of the blade.

This configuration of a propeller configured with angles $\alpha$ (alpha) and $\beta$ (beta), and preferably $\delta$ (delta) in the ranges indicated, results in a blade thrust surface which provides greatly improved efficiency vis-A-vis conventional blade configurations and the already improved efficiency of the blade configuration of the applicant's U.S. patent Ser. No. 12/326,097.

A blade constructed as described in FIGS. 16 through 21, using a reference cone with an apex angle 19.5 $\theta$ (theta), a 47° $\alpha$ (alpha) angle, a 57° $\beta$ (beta) angle, a distance of 228 mm between the cone apex and hub axis, a propeller radius of 90 mm (a ratio of 2.5 to 1 (apex to axis radius distance 2.5 times the propeller radius) and a blade center axis or cut-line 45 angled from the hub axis generator at an angle of about 142 degrees (or a blade with dimensions in similar ratios) produces significantly more thrust and torque than a standard helicoidal propeller of similar size. Open Water Propeller Testing demonstrates a 6% improvement inefficiency as compared to a standard helicoidal propeller of comparable size.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

I claim:

1. A propeller comprising:

a hub characterized by a hub axis and an axis of rotation; and one or more blades characterized by a root, a tip, a leading edge and a corresponding trailing edge, and a thrust surface; wherein, for each of the one or more blades:

the blade thrust surface conforms to a surface of a reference cone characterized by a vertex, a base, a vertical axis, and a plurality of generator lines; wherein in reference to the reference cone, the hub axis intersects a first generator line of the reference cone, and the blade thrust surface contains a straight path over the thrust surface corresponding to a second generator line; and the hub axis intersects the surface of the reference cone but is not tangent to the surface of the reference cone and does not intersect the vertical axis; wherein the hub axis is perpendicular to the first generator line.

2. A propeller comprising:

a hub characterized by a hub axis and an axis of rotation; and one or more blades characterized by a root, a tip, a leading edge and a corresponding trailing edge, and a thrust surface; wherein, for each of the one or more blades:

the blade thrust surface conforms to a surface of a reference cone characterized by a vertex, a base, a vertical axis, and a plurality of generator lines; wherein in reference to the reference cone, the hub axis intersects a first generator line of the reference cone, and the blade thrust surface contains a straight path over the thrust surface corresponding to a second generator line; and the hub axis intersects the surface of the reference cone but is not tangent to the surface of the reference cone and does not intersect the vertical axis; wherein the hub axis is perpendicular to the straight path on the blade surface which corresponds to the second generator line.

3. A propeller comprising:

a hub characterized by a hub axis and an axis of rotation; and one or more blades characterized by a root, a tip, a leading edge and a corresponding trailing edge, and a thrust surface; wherein, for each of the one or more blades:

the blade thrust surface conforms to a surface of a reference cone characterized by a vertex, a base, a vertical axis, and a plurality of generator lines; wherein in reference to the reference cone, the hub axis intersects a first generator line of the reference cone, and the blade thrust surface contains a straight path over the thrust surface corresponding to a second generator line; and the hub axis intersects the surface of the reference cone but is not tangent to the surface of the reference cone and does not intersect the vertical axis; wherein the hub axis is perpendicular to the first generator line; and the hub axis is perpendicular to the straight path on the blade surface which corresponds to the second generator line.

4. A propeller comprising:

a hub characterized by a hub axis and an axis of rotation; and one or more blades characterized by a root, a tip, a leading edge and a corresponding trailing edge, and a thrust surface; wherein, for each of the one or more blades, the blade thrust surface conforms to a surface of a reference cone, said blade thrust surface characterized by an arc spanning the blade from the leading edge to the trailing edge along which the gamma angle is 90 degrees, excepting an area of the thrust surface proximate the hub and proximate the trailing edge in which all gamma angles are acute.

5. A propeller comprising:

a hub characterized by a hub axis and an axis of rotation; and one or more blades characterized by a root, a tip, a leading edge and a corresponding trailing edge, and a thrust surface; wherein, for each of the one or more blades:

the blade thrust surface conforms to a surface of a reference cone, said blade thrust surface characterized by an arc spanning the blade from the leading edge to the trailing edge along which the gamma angle is 90 degrees; wherein the blade thrust surface is characterized by an arc spanning the blade from the leading edge to the trailing edge along which the gamma angle is 90 degrees, excepting an area of the thrust surface proximate the hub and proximate the leading edge in which all gamma angles are obtuse.

6. A propeller of claim 5, wherein:

in areas of the blade between the arc and the tip of the blade, gamma angles are acute, and in areas of the blade between the arc and the hub, gamma angles are obtuse.

7. A propeller comprising:

a hub characterized by a hub axis and an axis of rotation; and one or more blades characterized by a root, a tip, a leading edge and a corresponding trailing edge, and a thrust surface; wherein, for each of the one or more blades;

the blade thrust surface conforms to a surface of a reference cone, said blade thrust surface characterized by an arc spanning the blade from the leading edge to the trailing edge along which the gamma angle is 90 degrees; wherein in areas of the blade between the arc and the tip of the blade, gamma angles are acute, and in areas of the blade between the arc and the hub, gamma angles are obtuse.

* * * * *